US010537001B2

(12) United States Patent
Miskin et al.

(10) Patent No.: US 10,537,001 B2
(45) Date of Patent: Jan. 14, 2020

(54) MULTI-VOLTAGE AND MULTI-BRIGHTNESS LED LIGHTING DEVICES AND METHODS OF USING SAME

(71) Applicant: Lynk Labs, Inc., Elgin, IL (US)

(72) Inventors: Michael Miskin, Sleepy Hollow, IL (US); Robert L. Kottritsch, Shefford (GB)

(73) Assignee: Lynk Labs, Inc., Elgin, IL (US)

( * ) Notice: Subject to any disclaimer, the term of this patent is extended or adjusted under 35 U.S.C. 154(b) by 0 days.

(21) Appl. No.: 16/274,164

(22) Filed: Feb. 12, 2019

(65) Prior Publication Data

US 2019/0182919 A1 Jun. 13, 2019

Related U.S. Application Data

(63) Continuation of application No. 15/685,429, filed on Aug. 24, 2017, now Pat. No. 10,271,393, which is a (Continued)

(51) Int. Cl.
*H05B 33/08* (2006.01)

(52) U.S. Cl.
CPC ..... *H05B 33/0821* (2013.01); *H05B 33/0806* (2013.01); *Y10T 29/49002* (2015.01)

(58) Field of Classification Search
None
See application file for complete search history.

(56) References Cited

U.S. PATENT DOCUMENTS 3,869,641 A 3/1975 Goldberg
4,218,627 A 8/1980 Kiesel
(Continued)

FOREIGN PATENT DOCUMENTS

EP 1 215 944 6/2002
JP 08-137429 5/1996
(Continued)

OTHER PUBLICATIONS

European Search Report dated Oct. 22, 2012 in related European Application, seven (7) pages.
(Continued)

*Primary Examiner* — Crystal L Hammond
(74) *Attorney, Agent, or Firm* — Haynes and Boone, LLP

(57) ABSTRACT

A single chip multi-voltage or multi-brightness LED lighting device having at least two LED circuits. Each of the at least two LED circuits having at least two LEDs connected together in series. Each of the at least two LED circuits are electrically unconnected to each other in a parallel relationship, have a forward operating drive voltage of at least six volts and are monolithically integrated on a single substrate. A method of manufacturing a single chip with two or more LED circuits configurable by means of connecting the circuits so as to provide optional operating voltage level and/or desired brightness level wherein the electrical connection may be achieved and/or completed at the LED packaging level when the single chips are integrated into the LED package. Alternatively, the LED package may have external electrical contacts that match the integrated chips within. Optionally allowable, the drive voltage level and/or the brightness level select-ability may be passed on through to the exterior of the LED package and may be selected by the LED package user, the PCB assembly facility, or the end product manufacturer.

19 Claims, 8 Drawing Sheets

Related U.S. Application Data continuation of application No. 14/172,644, filed on Feb. 4, 2014, now Pat. No. 9,750,098, which is a continuation of application No. 13/322,796, filed as application No. PCT/US2010/001597 on May 28, 2010, now Pat. No. 8,648,539, and a continuation-in-part of application No. 12/287,267, filed on Oct. 6, 2008, now Pat. No. 8,179,055.

(60) Provisional application No. 61/217,215, filed on May 28, 2009, provisional application No. 60/997,771, filed on Oct. 6, 2007.

(56) References Cited

U.S. PATENT DOCUMENTS

| | | | | |
|---|---|---|---|---|
| 4,298,869 | A | 11/1981 | Okuno | |
| 5,699,218 | A | 12/1997 | Kadah | |
| 5,790,013 | A | 8/1998 | Hauck | |
| 6,107,744 | A | 8/2000 | Bavaro et al. | |
| 6,541,919 | B1 | 4/2003 | Roach et al. | |
| 6,614,103 | B1 | 9/2003 | Durocher et al. | |
| 6,781,570 | B1 | 8/2004 | Arrigo et al. | |
| 7,053,560 | B1 | 5/2006 | Ng | |
| 7,081,722 | B1 | 7/2006 | Huynh et al. | |
| 7,258,463 | B2 | 8/2007 | Sloan et al. | |
| 7,419,281 | B2 | 9/2008 | Porchia et al. | |
| 7,489,086 | B2 | 2/2009 | Miskin et al. | |
| 7,748,877 | B1 * | 7/2010 | Colby | F21K 9/00 315/185 S |
| 7,859,196 | B2 | 12/2010 | Lee et al. | |
| 7,961,113 | B2 | 6/2011 | Rabiner et al. | |
| 8,129,917 | B2 | 3/2012 | Kim et al. | |
| 8,148,905 | B2 | 4/2012 | Miskin et al. | |
| 8,179,055 | B2 | 5/2012 | Miskin et al. | |
| 8,198,819 | B2 * | 6/2012 | Lenk | H05B 33/0845 315/185 R |
| 8,203,275 | B2 | 6/2012 | Ruxton | |
| 2002/0080663 | A1 * | 6/2002 | Kameyama | H03K 19/0016 365/200 |
| 2003/0043611 | A1 | 3/2003 | Bockle et al. | |
| 2003/0122502 | A1 | 7/2003 | Clauberg et al. | |
| 2003/0169014 | A1 | 9/2003 | Kadah | |
| 2003/0175004 | A1 | 9/2003 | Garito et al. | |
| 2004/0075399 | A1 | 4/2004 | Hall | |
| 2004/0080941 | A1 | 4/2004 | Jiang et al. | |
| 2004/0183380 | A1 | 9/2004 | Otake | |
| 2004/0189218 | A1 | 9/2004 | Leong et al. | |
| 2004/0201988 | A1 | 10/2004 | Allen | |
| 2005/0040773 | A1 | 2/2005 | Lebens et al. | |
| 2005/0110426 | A1 | 5/2005 | Shao | |
| 2005/0168156 | A1 * | 8/2005 | Li | H05B 33/0803 315/185 R |
| 2005/0173990 | A1 | 8/2005 | Andersen et al. | |
| 2006/0038542 | A1 | 2/2006 | Park et al. | |
| 2006/0103913 | A1 | 5/2006 | Handschy et al. | |
| 2006/0138971 | A1 | 6/2006 | Uang et al. | |
| 2006/0158130 | A1 | 7/2006 | Furukawa | |
| 2006/0256826 | A1 | 11/2006 | Lin et al. | |
| 2007/0069663 | A1 | 3/2007 | Burdalski et al. | |
| 2007/0115248 | A1 | 5/2007 | Roberts et al. | |
| 2007/0139717 | A1 | 6/2007 | Kuo et al. | |
| 2007/0273299 | A1 * | 11/2007 | Miskin | H05B 33/0818 315/250 |
| 2008/0116816 | A1 | 5/2008 | Neuman et al. | |
| 2008/0130288 | A1 * | 6/2008 | Catalano | H05B 33/0803 362/294 |
| 2008/0136347 | A1 | 6/2008 | Lin et al. | |
| 2008/0158915 | A1 | 7/2008 | Williams | |
| 2008/0203405 | A1 * | 8/2008 | Rooymans | H01L 25/0753 257/91 |
| 2008/0203936 | A1 | 8/2008 | Mariyama et al. | |
| 2008/0211421 | A1 | 9/2008 | Lee et al. | |
| 2008/0218098 | A1 | 9/2008 | Lee et al. | |
| 2009/0009100 | A1 | 1/2009 | Rooymans | |
| 2009/0021185 | A1 | 1/2009 | Ng | |
| 2009/0167190 | A1 | 7/2009 | Hickey | |
| 2009/0174337 | A1 | 7/2009 | Miskin et al. | |
| 2009/0295300 | A1 | 12/2009 | King | |
| 2010/0039794 | A1 | 2/2010 | Ghanem et al. | |
| 2010/0072280 | A1 * | 3/2010 | McGill | G06K 19/06046 235/462.13 |
| 2010/0072905 | A1 | 3/2010 | Kim et al. | |
| 2011/0169408 | A1 | 7/2011 | Chen et al. | |
| 2011/0260648 | A1 | 10/2011 | Hamamoto et al. | |
| 2012/0043897 | A1 | 2/2012 | Miskin et al. | |
| 2012/0206050 | A1 | 8/2012 | Spero | |
| 2013/0051001 | A1 | 2/2013 | Miskin | |

FOREIGN PATENT DOCUMENTS

| | | |
|---|---|---|
| JP | 11-330561 | 11/1999 |
| WO | WO 03/075126 | 9/2003 |
| WO | WO 2005084080 | 9/2005 |
| WO | WO 2007001116 | 1/2007 |
| WO | WO 2008/062941 | 5/2008 |
| WO | WO 2008124701 | 10/2008 |
| WO | WO 2011049613 | 4/2011 |
| WO | WO 2011082168 | 7/2011 |
| WO | WO 2011143510 | 11/2011 |

OTHER PUBLICATIONS

International Search Report and Written Opinion for International Application No. PCT/US2010/001597 dated Jul. 30, 2010 containing 14 pages.

Examination Report Under Sections 12 & 13 of the Patent Act for Indian Application No. 9150/delnp/2011 dated Apr. 5, 2018, 6 pages.

Examination Report Under Sections 12 & 13 of the Patent Act, Indian Application No. 5795/DELNP/2012, dated Aug. 29, 2018, 6 pages.

Office Action, Canadian Application No. 2,763,598, dated Jul. 3, 2018, 3 pages.

Office Action received in U.S. Appl. No. 16/443,759, dated Aug. 8, 2019, 7 pages.

Office Action, U.S. Appl. No. 15/334,001, dated Sep. 13, 2019, 17 pages.

* cited by examiner

MULTI-VOLTAGE AND MULTI-BRIGHTNESS LED LIGHTING DEVICES AND METHODS OF USING SAME

RELATED APPLICATIONS

The present application is a continuation of U.S. patent application Ser. No. 15/685,429, filed Aug. 24, 2017, which is a continuation of U.S. patent application Ser. No. 14/172,644, filed Feb. 4, 2014, which is a continuation of U.S. patent application Ser. No. 13/322,796, filed Nov. 28, 2011, which is a national phase application of International Application No. PCT/US2010/001597, filed May 28, 2010, which claims priority to U.S. Provisional Application No. 61/217,215, filed May 28, 2009, and is a continuation-in-part of U.S. patent application Ser. No. 12/287,267, filed Oct. 6, 2008, which claims the priority to U.S. Provisional Application No. 60/997,771, filed Oct. 6, 2007; the contents of each of these applications are expressly incorporated herein by reference.

TECHNICAL FIELD

The present invention generally relates to light emitting diodes ("LEDs") for AC operation. The present invention specifically relates to multiple voltage level and multiple brightness level LED devices, packages and lamps.

FEDERALLY SPONSORED RESEARCH OR DEVELOPMENT

None.

BACKGROUND OF THE INVENTION

Field of the Invention

The present invention generally relates to light emitting diodes ("LEDs") for multi-voltage level and/or multi-brightness level operation. The present invention specifically relates to multiple voltage level and multiple brightness level light emitting diode circuits, single chips, packages and lamps "devices" for direct AC voltage power source operation, bridge rectified AC voltage power source operation or constant DC voltage power source operation.

Description of the Related Art

LEDs are semiconductor devices that produce light when a current is supplied to them. LEDs are intrinsically DC devices that only pass current in one polarity and historically have been driven by DC voltage sources using resistors, current regulators and voltage regulators to limit the voltage and current delivered to the LED. Some LEDs have resistors built into the LED package providing a higher voltage LED typically driven with 5V DC or 12V DC.

With proper design considerations LEDs may be driven more efficiently with direct AC or rectified AC than with constant voltage or constant current DC drive schemes.

Some standard AC voltage in the world include 12 VAC, 24 VAC, 100 VAC, 110 VAC, 120 VAC, 220 VAC, 230 VAC, 240 VAC and 277 VAC. Therefore, it would be advantageous to have a single chip LED or multi-chip single LED packages that could be easily configured to operate at multiple voltages by simply selecting a voltage and/or current level when packaging the multi-voltage and/or multi-current single chip LEDs or by selecting a specific voltage and/or current level when integrating the LED package onto a printed circuit board or within a finished lighting product. It would also be advantageous to have multi-current LED chips and/or packages for LED lamp applications in order to provide a means of increasing brightness in LED lamps by switching in additional circuits just as additional filaments are switched in for standard incandescent lamps.

U.S. Pat. No. 7,525,248 discloses a chip-scale LED lamp including discrete LEDs capable of being built upon electrically insulative, electrically conductive, or electrically semi conductive substrates. Further, the construction of the LED lamp enables the lamp to be configured for high voltage AC or DC power operation. The LED based solid-state light emitting device or lamp is built upon an electrically insulating layer that has been formed onto a support surface of a substrate. Specifically, the insulating layer may be epitaxially grown onto the substrate, followed by an LED buildup of an n-type semiconductor layer, an optically active layer, and a p-type semiconductor layer, in succession. Isolated mesa structure of individual, discrete LEDs is formed by etching specific portions of the LED buildup down to the insulating layer, thereby forming trenches between adjacent LEDs. Thereafter, the individual LEDs are electrically coupled together through conductive elements or traces being deposited for connecting the n-type layer of one LED and the p-type layer of an adjacent LED, continuing across all of the LEDs to form the solid-state light emitting device. The device may therefore be formed as an integrated AC/DC light emitter with a positive and negative lead for supplied electrical power. For instance, the LED lamp may be configured for powering by high voltage DC power (e.g., 12V, 24V, etc.) or high voltage AC power (e.g., 110/120V, 220/240V, etc.).

U.S. Pat. No. 7,213,942 discloses a single-chip LED device through the use of integrated circuit technology, which can be used for standard high AC voltage (110 volts for North America, and 220 volts for Europe, Asia, etc.) operation. The single-chip AC LED device integrates many smaller LEDs, which are connected in series. The integration is done during the LED fabrication process and the final product is a single-chip device that can be plugged directly into house or building power outlets or directly screwed into incandescent lamp sockets that are powered by standard AC voltages. The series connected smaller LEDs are patterned by photolithography, etching (such as plasma dry etching), and metallization on a single chip. The electrical insulation between small LEDs within a single-chip is achieved by etching light emitting materials into the insulating substrate so that no light emitting material is present between small LEDs. The voltage crossing each one of the small LEDs is about the same as that in a conventional DC operating LED fabricated from the same type of material (e.g., about 3.5 volts for blue LEDs).

Accordingly, single chip LEDs have been limited and have not been integrated circuits beyond being fixed series or fixed parallel circuit configurations until the development of AC LEDs. The AC LEDs have still however been single circuit, fixed single voltage designs.

LED packages have historically not been integrated circuits beyond being fixed series or fixed parallel circuit configurations.

The art is deficient in that it does not provide a multi-voltage and/or multi-current circuit monolithically integrated on a single substrate which would be advantageous.

It would further be advantageous to have a multi-voltage and/or multi-brightness circuit that can provide options in voltage level, brightness level and/or AC or DC powering input power preference.

It would further be advantageous to provide multiple voltage level and/or multiple brightness level light emitting LED circuits, chips, packages and lamps "multi-voltage and/or multi-brightness LED devices" that can easily be electrically configured for at least two forward voltage drive levels with direct AC voltage coupling, bridge rectified AC voltage coupling or constant voltage DC power source coupling. This invention comprises circuits and devices that can be driven with more than one AC or DC forward voltage "multi-voltage" at 6V or greater based on a selectable desired operating voltage level that is achieved by electrically connecting the LED circuits in a series or parallel circuit configuration and/or more than one level of brightness "multi-brightness" based on a switching means that connects and/or disconnects at least one additional LED circuit to and/or from a first LED circuit. The desired operating voltage level and/or the desired brightness level electrical connection may be achieved and/or completed at the LED packaging level when the multi-voltage and/or multi-brightness circuits and/or single chips are integrated into the LED package, or the LED package may have external electrical contacts that match the integrated multi-voltage and/or multi-brightness circuits and/or single chips within, thus allowing the drive voltage level and/or the brightness level select-ability to be passed on through to the exterior of the LED package and allowing the voltage level or brightness level to be selected at the LED package user, or the PCB assembly facility, or the end product manufacturer.

It would further be advantageous to provide at least two integrated circuits having a forward voltage of at least 12 VAC or 12 VDC or greater on a single chip or within a single LED package that provide a means of selecting a forward voltage when packaging a multi-voltage and/or multi-brightness circuit using discrete die (one LED chip at a time) and wire bonding them into a circuit at the packaging level or when packaging one or more multi-voltage and/or multi-brightness level single chips within a LED package.

It would further be advantageous to provide multi-voltage and/or multi-brightness level devices that can provide electrical connection options for either AC or DC voltage operation at preset forward voltage levels of 6V or greater.

It would further be advantageous to provide multi-brightness LED devices that can be switched to different levels of brightness by simply switching additional circuits on or off in addition to a first operating circuit within a single chip and or LED package. This would allow LED lamps to switch to higher brightness levels just like 2-way or 3-way incandescent lamps do today.

The benefits of providing multi-voltage circuits of 6V or greater on a single chip is that an LED packager can use this single chip as a platform to offer more than one LED packaged product with a single chip that addresses multiple voltage levels for various end customer design requirements. This also increase production on a single product for the chip maker and improves inventory control. This also improves buying power and inventory control for the LED packager when using one chip.

The present invention provides for these advantages and solves the deficiencies in the art.

SUMMARY OF THE INVENTION

According to one aspect of the invention at least two single voltage AC LED circuits are formed on a single chip or on a substrate providing a multi-voltage AC LED device for direct AC power operation. Each single voltage AC LED circuit has at least two LEDs connected to each other in opposing parallel relation.

According to another aspect of the invention, each single voltage AC LED circuit is designed to be driven with a predetermined forward voltage of at least 6 VAC and preferably each single voltage AC LED circuit has a matching forward voltage of 6 VAC, 12 VAC, 24 VAC, 120 VAC, or other AC voltage levels for each single voltage AC LED circuit.

According to another aspect of the invention, each multi-voltage AC LED device would be able to be driven with at least two different AC forward voltages resulting in a first forward voltage drive level by electrically connecting the two single voltage AC LED circuits in parallel and a second forward voltage drive level by electrically connecting the at least two single voltage level AC LED circuits in series. By way of example, the second forward voltage drive level of the serially connected AC LED circuits would be approximately twice the level of the first forward voltage drive level of the parallel connected AC LED circuits. The at least two parallel connected AC LED circuits would be twice the current of the at least two serially connected AC LED circuits. In either circuit configuration, the brightness would be approximately the same with either forward voltage drive selection of the multi-voltage LED device.

According to another aspect of the invention, at least two single voltage series LED circuits, each of which have at least two serially connected LEDs, are formed on a single chip or on a substrate providing a multi-voltage AC or DC operable LED device.

According to another aspect of the invention, each single voltage series LED circuit is designed to be driven with a predetermined forward voltage of at least 6V AC or DC and preferably each single voltage series LED circuit has a matching forward voltage of 6V, 12V, 24V, 120V, or other AC or DC voltage levels. By way of example, each multi-voltage AC or DC LED device would be able to be driven with at least two different AC or DC forward voltages resulting in a first forward voltage drive level by electrically connecting the two single voltage series LED circuits in parallel and a second forward voltage drive level by electrically connecting the at least two single voltage level series LED circuits in series. The second forward voltage drive level of the serially connected series LED circuits would be approximately twice the level of the first forward voltage drive level of the parallel connected series LED circuits. The at least two parallel connected series LED circuits would be twice the current of the at least two serially connected series LED circuits. In either circuit configuration, the brightness would be approximately the same with either forward voltage drive selection of the multi-voltage series LED device.

According to another aspect of the invention, at least two single voltage AC LED circuits are formed on a single chip or on a substrate providing a multi-voltage and/or multi-brightness AC LED device for direct AC power operation.

According to another aspect of the invention, each single voltage AC LED circuit has at least two LEDs connected to each other in opposing parallel relation. Each single voltage AC LED circuit is designed to be driven with a predetermined forward voltage of at least 6 VAC and preferably each single voltage AC LED circuit has a matching forward voltage of 6 VAC, 12 VAC, 24 VAC, 120 VAC, or other AC voltage levels for each single voltage AC LED circuit. The at least two AC LED circuits within each multi-voltage and/or multi current AC LED device would be left able to be driven with at least two different AC forward voltages resulting in a first forward voltage drive level by electrically connecting the two single voltage AC LED circuits in parallel and a second forward voltage drive level by electrically connecting the at least two single voltage level AC LED circuits in series. The second forward voltage drive level of the serially connected AC LED circuits would be approximately twice the level of the first forward voltage drive level of the parallel connected AC LED circuits. The at least two parallel connected AC LED circuits would be twice the current of the at least two serially connected AC LED circuits. In either circuit configuration, the brightness would be approximately the same with either forward voltage drive selection of the multi-voltage LED device.

According to another aspect of the invention at least two single voltage LED circuits are formed on a single chip or on a substrate, and at least one bridge circuit made of LEDs is formed on the same single chip or substrate providing a multi-voltage and/or multi-brightness LED device for direct DC power operation. Each single voltage LED circuit has at least two LEDs connected to each other in series. Each single voltage LED circuit is designed to be driven with a predetermined forward voltage and preferably matching forward voltages for each circuit such as 12 VDC, 24 VDC, 120 VDC, or other DC voltage levels for each single voltage LED circuit. Each multi-voltage and/or multi-brightness LED device would be able to be driven with at least two different DC forward voltages resulting in a first forward voltage drive level when the two single voltage LED circuits are connected in parallel and a second forward voltage drive level that is twice the level of the first forward voltage drive level when the at least two LED circuits are connected in series.

According to another aspect of the invention at least two single voltage LED circuits are formed on a single chip or on a substrate providing a multi-voltage and/or multi-brightness LED device for direct DC power operation. Each single voltage LED circuit has at least two LEDs connected to each other in series. Each single voltage LED circuit is designed to be driven with a predetermined forward voltage and preferably matching forward voltages for each circuit such as 12 VAC, 24 VAC, 120 VAC, or other DC voltage levels for each single voltage LED circuit. Each multi-voltage and/or multi-brightness LED device would be able to be driven with at least two different DC forward voltages resulting in a first forward voltage drive level when the two single voltage LED circuits are connected in parallel and a second forward voltage drive level that is twice the level of the first forward voltage drive level when the at least two LED circuits are connected in series.

According to another aspect of the invention at least two single voltage LED circuits are formed on a single chip or on a substrate, and at least one bridge circuit made of LEDs is formed on the same single chip or substrate providing a multi-voltage and/or multi-brightness LED device for direct DC power operation. Each single voltage LED circuit has at least two LEDs connected to each other in series. Each single voltage LED circuit is designed to be driven with a predetermined forward voltage and preferably matching forward voltages for each circuit such as 12 VDC, 24 VDC, 120 VDC, or other DC voltage levels for each single voltage LED circuit. Each multi-voltage and/or multi-brightness LED device would be able to be driven with at least two different DC forward voltages resulting in a first forward voltage drive level when the two single voltage LED circuits are connected in parallel and a second forward voltage drive level that is twice the level of the first forward voltage drive level when the at least two LED circuits are connected in series.

According to another aspect of the invention a multi-voltage and/or multi-current AC LED circuit is integrated within a single chip LED. Each multi-voltage and/or multi-current single chip AC LED LED comprises at least two single voltage AC LED circuits. Each single voltage AC LED circuit has at least two LEDs in anti-parallel configuration to accommodate direct AC voltage operation. Each single voltage AC LED circuit may have may have at least one voltage input electrical contact at each opposing end of the circuit or the at least two single voltage AC LED circuits may be electrically connected together in series on the single chip and have at least one voltage input electrical contact at each opposing end of the two series connected single voltage AC LED circuits and one voltage input electrical contact at the center junction of the at least two single voltage AC LED circuits connected in series. The at least two single voltage AC LED circuits are integrated within a single chip to form a multi-voltage and/or multi-current single chip AC LED.

According to another aspect of the invention, at least one multi-voltage and/or multi-brightness LED devices may be integrated within a LED lamp. The at least two individual LED circuits within the multi-voltage and/or multi-brightness LED device(s) may be wired in a series or parallel circuit configuration by the LED packager during the LED packaging process thus providing for at least two forward voltage drive options, for example 12 VAC and 24 VAC or 120 VAC and 240 VAC that can be selected by the LED packager.

According to another aspect of the invention a multi-voltage and/or multi-current AC LED package is provided, comprising at least one multi-voltage and/or multi-current single chip AC LED integrated within a LED package. The multi-voltage and/or multi-current AC LED package provides matching electrical connectivity pads on the exterior of the LED package to the electrical connectivity pads of the at least one multi-voltage and/or multi-current single chip AC LED integrated within the LED package thus allowing the LED package user to wire the multi-voltage and/or multi-current AC LED package into a series or parallel circuit configuration during the PCB assembly process or final product integration process and further providing a AC LED package with at least two forward voltage drive options.

According to another aspect of the invention multiple individual discrete LED chips are used to form at least one multi-voltage and/or multi-current AC LED circuit within a LED package thus providing a multi-voltage and/or multi current AC LED package. Each multi-voltage and/or multi-current AC LED circuit within the package comprises at least two single voltage AC LED circuits. Each single voltage AC LED circuit has at least two LEDs in anti-parallel configuration to accommodate direct AC voltage operation The LED package provides electrical connectivity pads on the exterior of the LED package that match the electrical connectivity pads of the at least two single voltage AC LED circuits integrated within the multi-voltage and/or multi-current AC LED package thus allowing the LED package to be wired into a series or parallel circuit configuration during the PCB assembly process and further providing a LED package with at least two forward voltage drive options.

According to another aspect of the invention a multi-voltage and/or multi-current single chip AC LED and/or multi-voltage and/or multi current AC LED package is integrated within an LED lamp. The LED lamp having a structure that comprises a heat sink, a lens cover and a standard lamp electrical base. The multi-voltage and/or multi-current single chip AC LED and/or package is configured to provide a means of switching on at least one additional single voltage AC LED circuit within multi-voltage and/or multi-current AC LED circuit to provide increased brightness from the LED lamp.

According to anther broad aspect of the invention at least one multi-current AC LED single chip is integrated within a LED package.

According to another aspect of the invention, at least one single chip multi-current LED bridge circuit is integrated within a LED lamp having a standard lamp base. The single chip multi-current LED bridge circuit may be electrically connected together in parallel configuration but left open to accommodate switching on a switch to the more than one on the single chip and have at least one accessible electrical contact at each opposing end of the two series connected circuits and one accessible electrical contact at the center junction of the at least two individual serially connected LED circuits. The at least two individual circuits are integrated within a single chip.

According to another aspect of the invention When the at least two circuits are left unconnected on the single chip and provide electrical pads for connectivity during the packaging process, the LED packager may wire them into series or parallel connection based on the desired voltage level specification of the end LED package product offering.

According to another broad aspect of the invention a multi-brightness single chip AC LED is provided having at least two LED circuits. Each LED circuit has at least two diodes connected to each other in opposing parallel relation, at least one of which such diodes is an LED thus forming an AC LED circuit that is integrated on a single chip. Each LED circuit within the multi-brightness single chip AC LED is designed to be driven in parallel with the same matching forward voltage such as 12 VAC, 24 VAC, 120 VAC, or other AC voltages level. Each multi-brightness single chip AC LED is designed to operate on at least one single circuit integrated within the multi-brightness single chip AC LED. The multi-brightness single chip AC LED operates on a switch having at least two positions each of which is connected to at least one circuit within the multi-brightness single chip AC LED.

It should be noted that "package" or "packaged" is defined herein as an integrated unit meant to be used as a discrete component in either of the manufacture, assembly, installation, or modification of an LED lighting device or system. Such a package includes LED's of desired characteristics with capacitors and or resistors sized relative to the specifications of the chosen opposing parallel LED's to which they will be connected in series and with respect to a predetermined AC voltage and frequency.

Preferred embodiments of a package may include an insulating substrate whereon the LEDs, capacitors and or resistors are formed or mounted. In such preferred embodiments of a package the substrate will include electrodes or leads for uniform connection of the package to a device or system associated with an AC driver or power source. The electrodes, leads, and uniform connection may include any currently known means including mechanical fit, and/or soldering. The substrate may be such as sapphire, silicon carbide, galium nitride, ceramics, printed circuit board material, or other materials for hosting circuit components.

A package in certain applications may preferably also include a heat sink, a reflective material, a lens for directing light, phosphor, nano-chrystals or other light changing or enhancing substances. In sum, according to one aspect of the invention, the LED circuits and AC drivers of the present invention permit pre-packaging of the LED portion of a lighting system to be used with standardized drivers of known specified voltage and frequency output. Such packages can be of varied make up and can be combined with each other to create desired systems given the scalable and compatible arrangements possible with, and resulting from, the invention.

According to one aspect of the invention, AC driven LED circuits (or "driven circuits") permit or enable lighting systems where LED circuits may be added to or subtracted (either by choice or by way of a failure of a diode) from the driven circuit without significantly affecting the pre-determined desired output range of light from any individual LED and, without the need to: (i) change the value of any discrete component; or, (ii) to add or subtract any discrete components, of any of the pre-existing driven circuit components which remain after the change. During design of a lighting system, one attribute of the LEDs chosen will be the amount of light provided during operation. In this context, it should be understood that depending on the operating parameters of the driver chosen, the stability or range of the voltage and frequency of the driver will vary from the nominal specification based upon various factors including but not limited to, the addition or subtraction of the LED circuits to which it becomes connected or disconnected. Accordingly, as sometimes referred to herein, drivers according to the invention are described as providing "relatively constant" or "fixed" voltage and frequency. The extent of this relative range may be considered in light of the acceptable range of light output desired from the resulting circuit at the before, during, or after a change has been made to the lighting system as a whole. Thus it will be expected that a pre-determined range of desired light output will be determined within which the driven LED circuits of the invention will perform whether or not additional or different LED circuits have been added or taken out of the driven circuit as a whole.

According to an aspect of the invention, an LED circuit driver provides a relatively fixed voltage and relatively fixed frequency AC output such as mains power sources. The LED circuit driver output voltage and frequency delivered to the LED circuit may be higher or lower than mains power voltage and frequencies by using an LED circuit inverter driver.

The higher frequency LED circuit inverter driver may be a electronic transformer, halogen or high intensity discharge (HID) lamp type driver with design modifications for providing a relatively fixed voltage as the LED circuit load changes. Meaning if the LED circuit inverter driver is designed to have an output voltage of 12V LED circuit driver would provide this output as a relatively constant output to a load having one or more than one LED circuits up to the wattage limit of the LED circuit driver even if LED circuits were added to or removed from the output of the LED circuit driver.

The higher frequency inverter having a relatively fixed voltage allows for smaller components to be used and provides a known output providing a standard reference High Frequency LED circuit driver.

Prior art for single chip LED circuits, for example those disclosed in 02004023568 and JP2004006582 do not provide a way to reduce the number of LEDs within the chip below the total forward voltage drop requirements of the source. The present invention however, enables an LED circuit to be made with any number of LEDs within a single chip, package or module by using capacitors or RC networks to reduce the number of LEDs needed to as few as one single LEO. Improved reliability, integration, product and system scalability and solid state lighting design simplicity may be realized with LED circuits and the LED circuit drivers. Individual LED circuits being the same or different colors, each requiring different forward voltages and currents may be driven from a single source LED circuit driver. Each individual LED circuit can self-regulate current by matching the capacitor or RC network value of the LED circuit to the known relatively fixed voltage and frequency of the LED circuit driver whether the LED circuit driver is a mains power source, a high frequency LED circuit driver or other LED circuit driver capable of providing a relatively fixed voltage and relatively fixed frequency output.

According to other aspects of the invention, the LED circuit driver may be coupled to a dimmer switch that regulates voltage or frequency or may have integrated circuitry that allows for adjustability of the otherwise relatively fixed voltage and/or relatively fixed frequency output of the LED circuit driver. The LED circuits get brighter as the voltage and/or frequency of the LED circuit driver output is increased to the LED circuits.

DETAILED DESCRIPTION OF PREFERRED EMBODIMENTS

Figure 1:
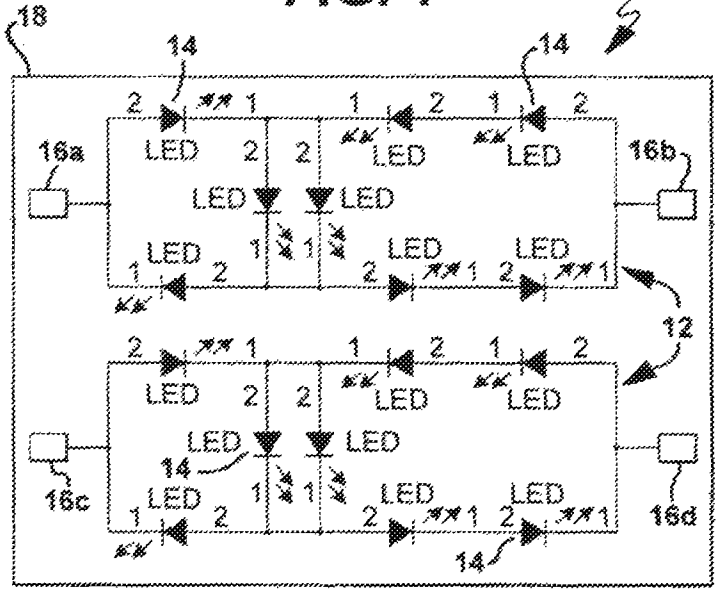
FIG. 1 shows a schematic view of a preferred embodiment of the invention.

FIG. 1 discloses a schematic diagram of a multi-voltage and/or multi-brightness LED lighting device 10. The multi-voltage and/or multi-brightness LED lighting device 10 comprises at least two AC LED circuits 12 configured in a imbalanced bridge circuit, each of which have at least two LEDs 14. The at least two AC LED circuits have electrical contacts 16*a*, 16*b*, 16*c*, and 16*d* at opposing ends to provide various connectivity options for an AC voltage source input. For example, if 16*a* and 16*c* are electrically connected together and 16*b* and 16*d* are electrically connected together and one side of the AC voltage input is applied to 16*a* and 16*c* and the other side of the AC voltage input is applied to 16*b* and 16*d*, the circuit becomes a parallel circuit with a first operating forward voltage. If only 16*a* and 16*c* are electrically connected and the AC voltage inputs are applied to electrical contacts 16*b* and 16*d*, a second operating forward voltage is required to drive the single chip 18. The single chip 18 may also be configured to operate at more than one brightness level "multi-brightness" by electrically connecting for example 16*a* and 16*b* and applying one side of the line of an AC voltage source to 16*a* ad 16*b* and individually applying the other side of the line from the AC voltage source a second voltage to 26*b* and 26*c*.

Figure 2:
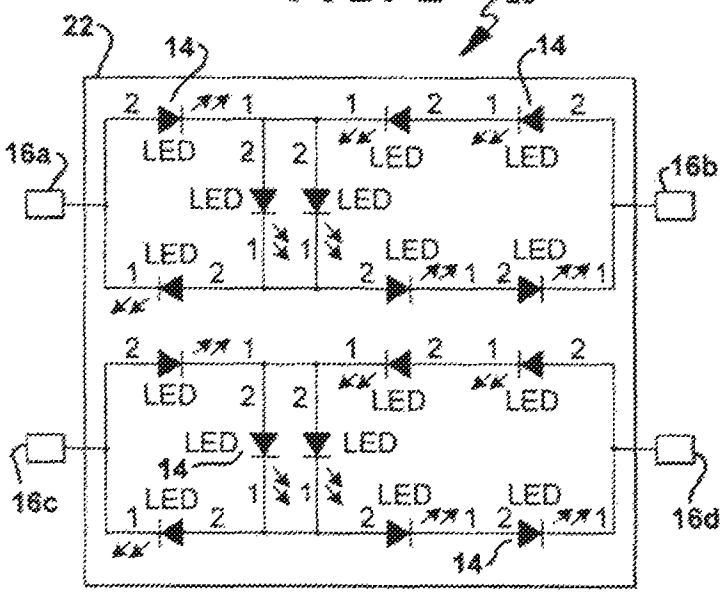
FIG. 2 shows a schematic view of a preferred embodiment of the invention.

FIG. 2 discloses a schematic diagram of a multi-voltage and/or multi-brightness LED lighting device 20 similar to the multi-voltage and/or multi-brightness LED lighting device 10 described above in FIG. 1. The at least two AC LED circuits 12 are integrated onto a substrate 22. The at least two AC LED circuits 12 configured in a imbalanced bridge circuit, each of which have at least two LEDs 14. The at least two AC LED circuits have electrical contacts 16*a*, 16*b*, 16*c*, and 16*d* on the exterior of the substrate 22 and can be used to electrically configure and/or control the operating voltage and/or brightness level of the multi-voltage and/or multi-brightness LED lighting device.

Figure 3:
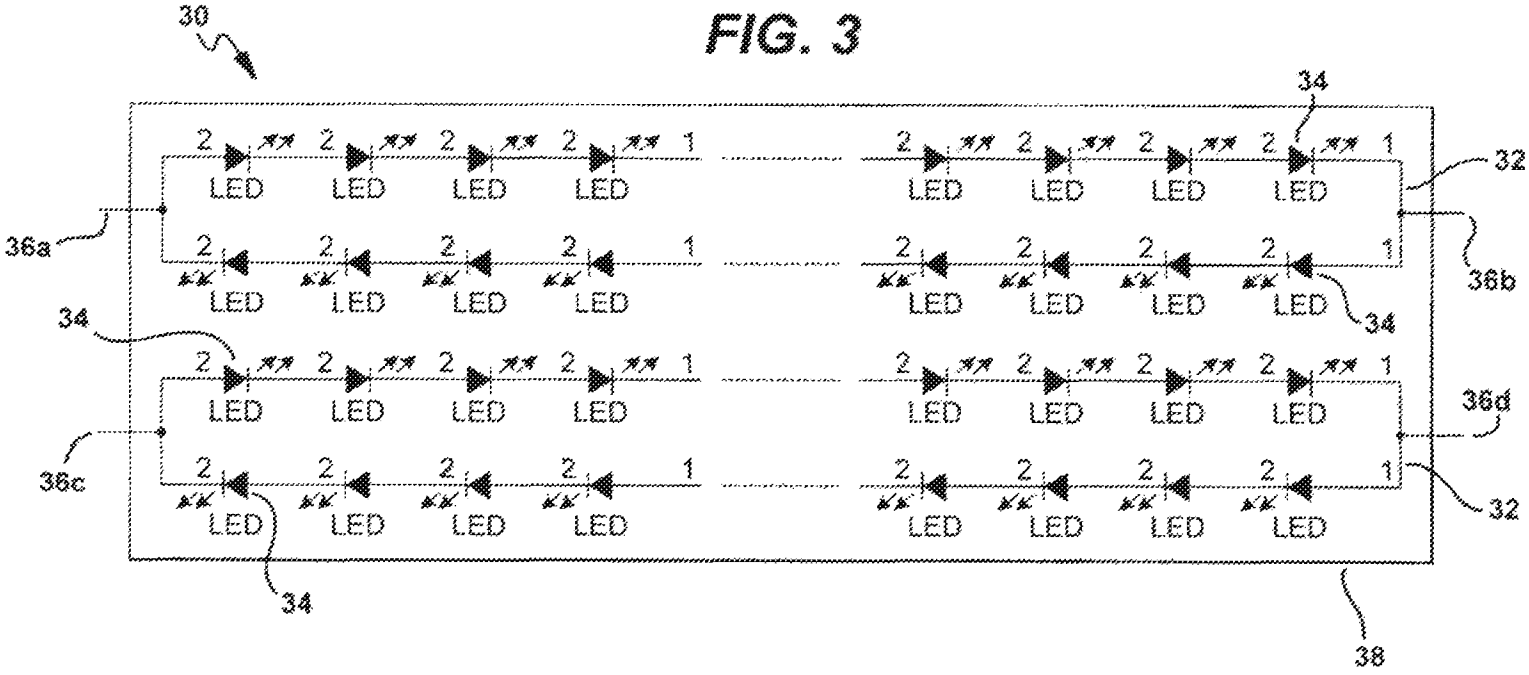
FIG. 3 shows a schematic view of a preferred embodiment of the invention.

FIG. 3 discloses a schematic diagram of a multi-voltage and/or multi-brightness LED lighting device 30 similar to the multi-voltage and/or multi-brightness LED lighting device 10 and 20 described in FIGS. 1 and 2. The multi-voltage and/or multi-brightness LED lighting device 30 comprises at least two AC LED circuits 32 having at least two LEDs 34 connected in series and anti-parallel configuration. The at least two AC LED circuits 32 have electrical contacts 36*a*, 36*b*, 36*c*, and 36*d* at opposing ends to provide various connectivity options for an AC voltage source input. For example, if 36*a* and 36*c* are electrically connected together and 36*b* and 36*d* are electrically connected together and one side of the AC voltage input is applied to 36*a* and 36*c* and the other side of the AC voltage input is applied to 36*b* and 36*d*, the circuit becomes a parallel circuit with a first operating forward voltage. If only 36*a* and 36*c* are electrically connected and the AC voltage inputs are applied to electrical contacts 36*b* and 36*d*, a second operating forward voltage is required to drive the multi-voltage and/or multi-brightness lighting device 30. The multi-voltage and/or multi-brightness lighting device 30 may be a monolithically integrated single chip 38, a monolithically integrated single chip integrated within a LED package 38 or a number of individual discrete die integrated onto a substrate 38 to form a multi-voltage and/or multi-brightness lighting device 30.

Figure 4:
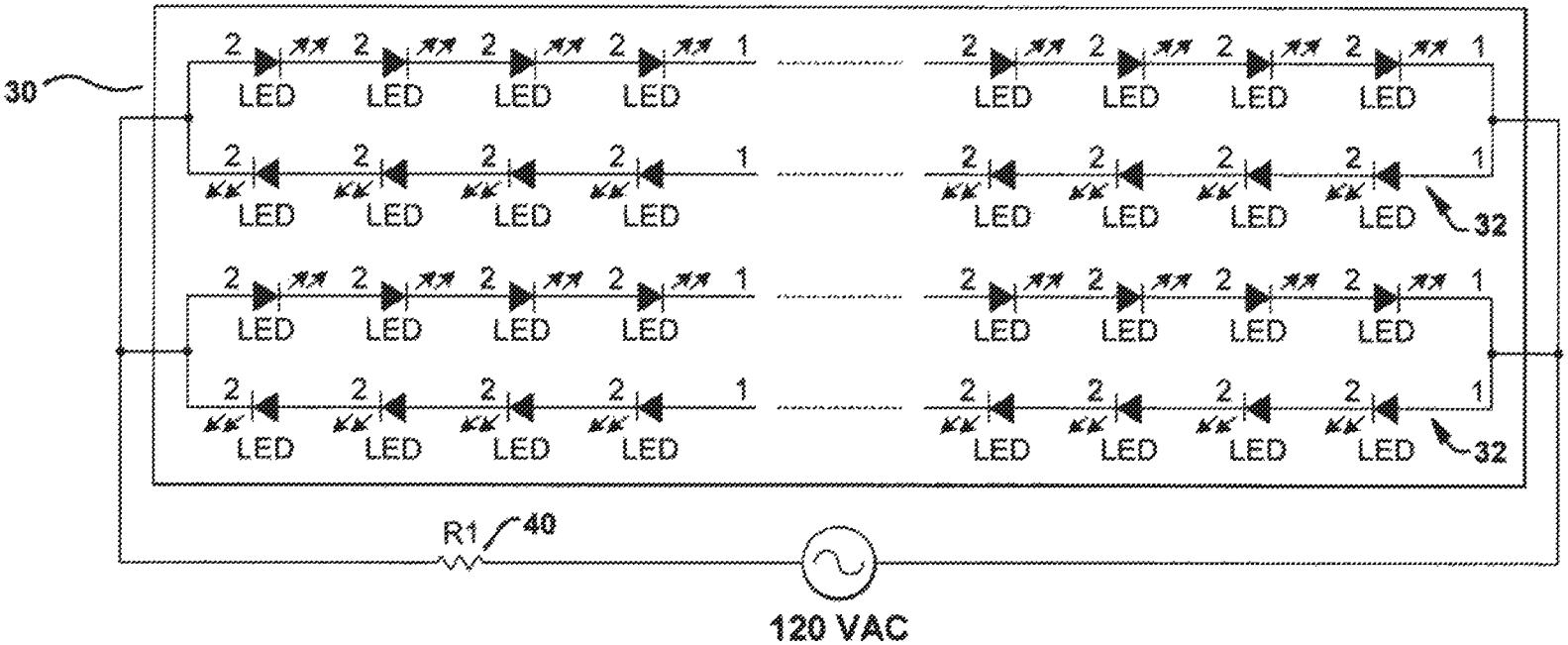
FIG. 4 shows a schematic view of a preferred embodiment of the invention.

FIG. 4 discloses a schematic diagram of the same multi-voltage and/or multi-brightness LED device 30 as described in FIG. 3 having the at least two AC LED circuits 32 connected in parallel configuration to an AC voltage source and operating at a first forward voltage. A resistor 40 may be used to limit current to the multi-voltage and/or multi-brightness LED lighting device 30.

Figure 5:
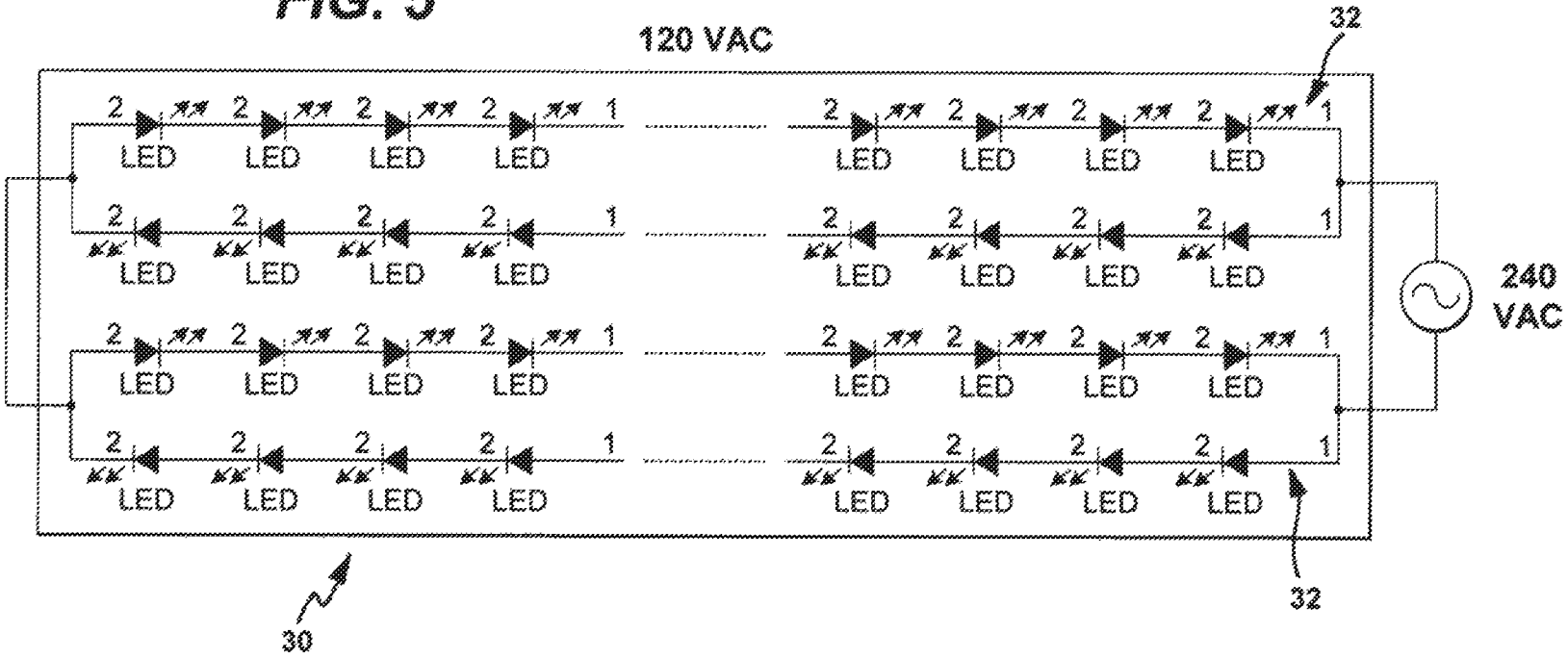
FIG. 5 shows a schematic view of a preferred embodiment of the invention.

FIG. 5 discloses a schematic diagram of the same multi-voltage and/or multi-brightness LED device 30 as described in FIG. 3 having the at least two AC LED circuits 32 connected in series configuration to an AC voltage source and operating at a second forward voltage that is approximately two times greater than the first forward voltage of the parallel circuit as described in FIG. 4. A resistor may be used to limit current to the multi-voltage and/or multi-brightness LED lighting device.

Figure 6:
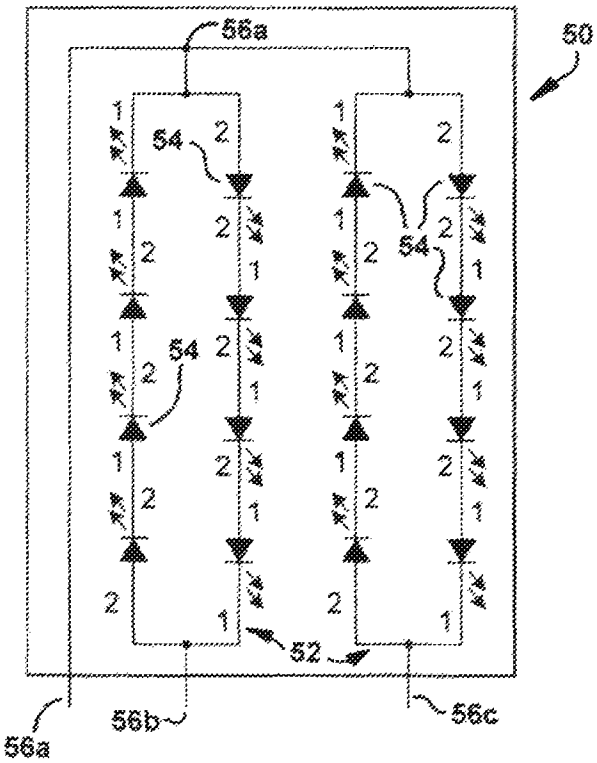
FIG. 6 shows a schematic view of a preferred embodiment of the invention.

FIG. 6 discloses a schematic diagram of a multi-voltage and/or multi-brightness LED lighting device 50. The multi-voltage and/or multi-brightness LED lighting device 50 comprises at least two AC LED circuits 52, each of which have at least two LEDs 54 in series and anti-parallel relation. The at least two AC LED circuits 52 have at least three electrical contacts 56*a*, 56*b* and 56*c*. The at least two AC LED circuits 52 are electrically connected together in parallel at one end 56*a* and left unconnected at the opposing ends of the electrical contacts 56*b* and 56*c*. One side of an AC voltage source line is electrically connected to 56*a* and the other side of an AC voltage source line is individually electrically connected to 56*b* and 56*c* with either a fixed connection or a switched connection thereby providing a first brightness when AC voltage is applied to 56*a* and 56*b* and a second brightness when an AC voltage is applied to 56*a*, 56*b* and 56*c*. It is contemplated that the multi-voltage and/or multi-brightness LED lighting device 50 is a single chip, an LED package, an LED assembly or an LED lamp. The multi-brightness switching capability.

Figure 7:
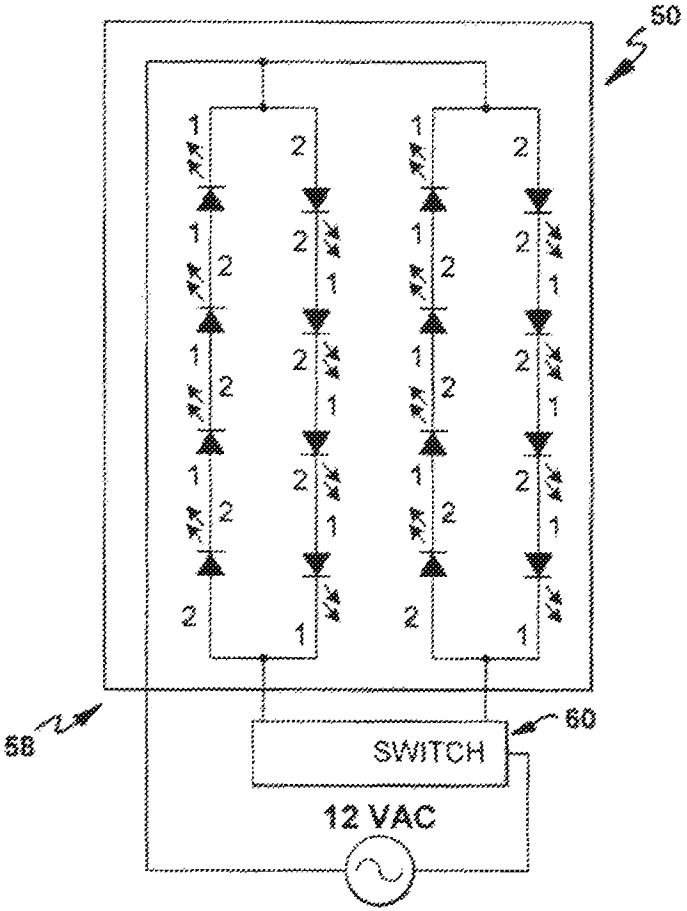
FIG. 7 shows a schematic view of a preferred embodiment of the invention.

FIG. 7 discloses a schematic diagram similar to the multi-voltage and/or multi-brightness LED device 50 shown in FIG. 6 integrated within a lamp 58 and connected to a switch 60 to control the brightness level of the multi-voltage and/or multi-brightness LED lighting device 50.

Figure 8:
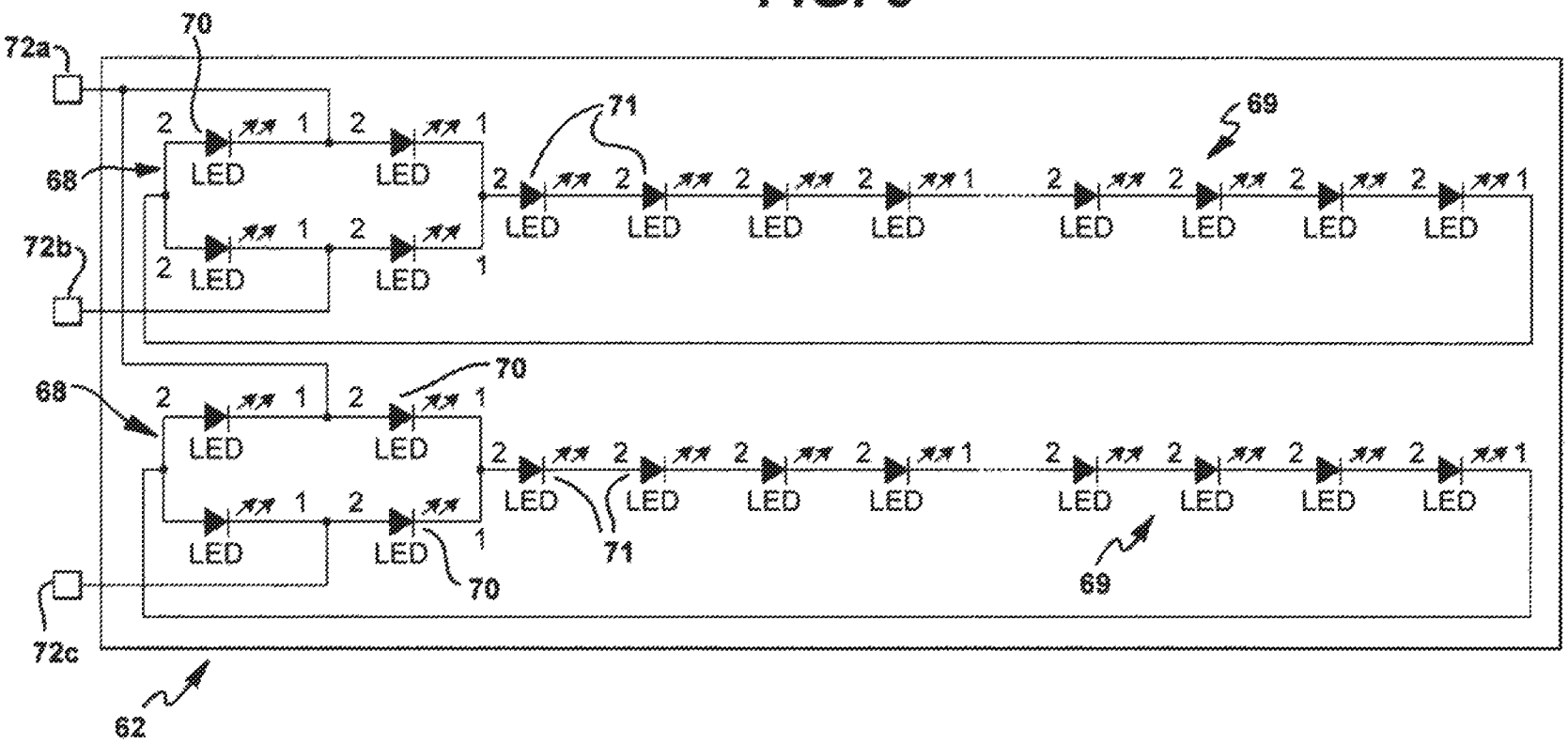
FIG. 8 shows a schematic view of a preferred embodiment of the invention.

FIG. 8 discloses a schematic diagram a multi-brightness LED lighting device 62 having at least two bridge rectified 68 series LED circuits 69. Each of the at least two bridge rectified 68 series LED circuits 69 that are connected to and rectified with an LED bridge circuit 68 comprising four LEDs 70 configured in a bridge circuit 68. The at least two bridge rectified 68 series LED circuits 69 have at least two LEDs 71 connected in series and electrical contacts 72*a*, 72*b* and 72*c*. When one side of an AC voltage is applied to 72*a* and the other side of an AC voltage line is applied to 72*b* and 72*c* individually, the brightness level of the multi-brightness LED lighting device 62 can be increased and/or decreased I a fixed manner or a switching process.

Figure 9:
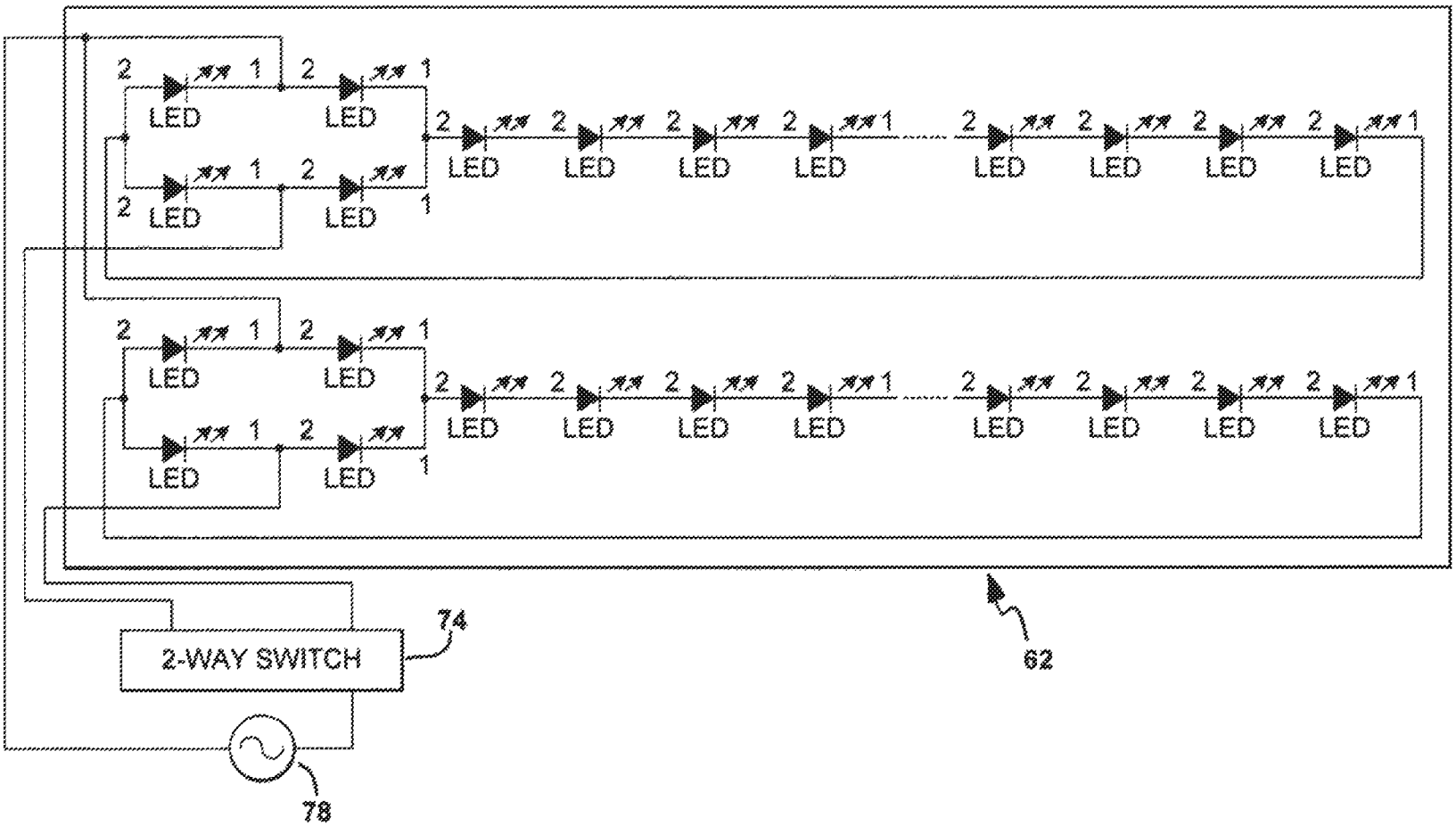
FIG. 9 shows a schematic view of a preferred embodiment of the invention.

FIG. 9 discloses a schematic diagram the multi-brightness LED lighting device 62 as shown above in FIG. 8 with a switch 74 electrically connected between the multi-brightness LED lighting device 62 and the AC voltage source 78.

FIG. 9 discloses a schematic diagram of at least two single voltage LED circuits integrated with a single chip or within a substrate and forming a multi-voltage and/or multi-brightness LED device.

Figure 10:
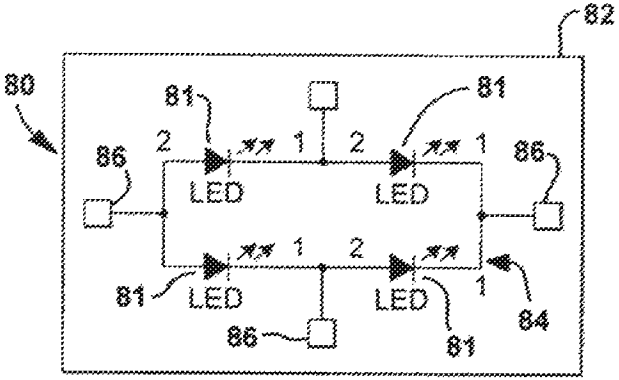
FIG. 10 shows a schematic view of a preferred embodiment of the invention.

FIG. 10 discloses a schematic diagram of a single chip LED bridge circuit 80 having four LEDs 81 configured into a bridge circuit and monolithically integrated on a substrate 82. The full wave LED bridge circuit has electrical contacts 86 to provide for AC voltage input connectivity and DC voltage output connectivity.

Figure 11:
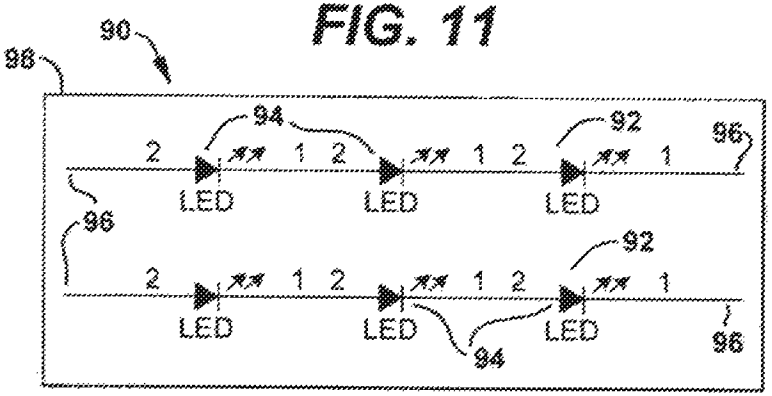
FIG. 11 shows a schematic view of a preferred embodiment of the invention; and, FIG. 12 shows a schematic view of a preferred embodiment of the invention.

FIG. 11 discloses a schematic diagram of another embodiment of a single chip multi-voltage and/or multi-brightness LED lighting device 90. The multi-voltage and/or multi-brightness LED lighting device 90 has at least two series LED circuits 92 each of which have at least two LEDs 94 connected in series. The at least two series LED circuits 92 have electrical contacts 96 at opposing ends to provide a means of electrical connectivity. The at least two series LED circuits are monolithically integrated into a single chip 98. The electrical contacts 96 are used to wire the at least two series LEDs circuit 92 into a series circuit, a parallel circuit or an AC LED circuit all within a single chip.

Figure 12:
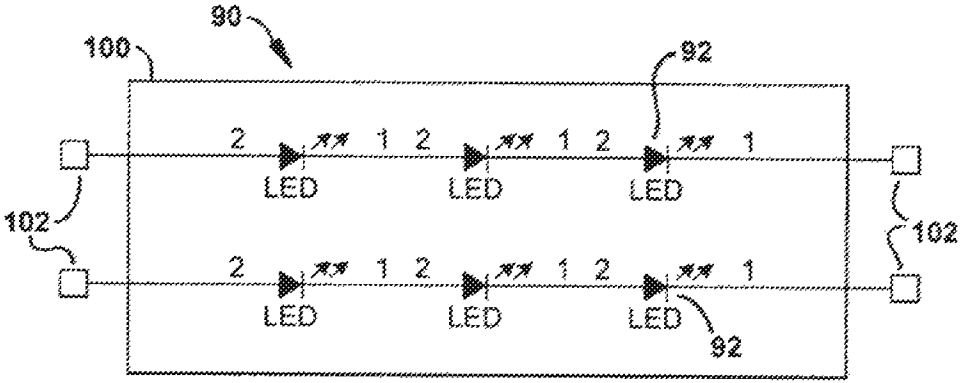

FIG. 12 discloses a schematic diagram of the same multi-voltage and/or multi-brightness LED lighting device 90 as shown above in FIG. 11. The multi-voltage and/or multi-brightness LED lighting device 90 has at least two series LED circuits 92 each of which have at least two LEDs 94 connected in series. The at least two series LED circuits can be monolithically integrated within a single chip or discrete individual die can be integrated within a substrate to form an LED package 100. The LED package 100 has electrical contacts 102 that are used to wire the at least two series LEDs circuit into a series circuit, a parallel circuit or in anti-parallel to form an AC LED circuit all within a single LED package.

What is claimed is:

1. An LED lighting device comprising:

a first operating LED circuit and at least one additional LED circuit, wherein at least one of the first operating LED circuit or the at least one additional LED circuit includes at least two LEDs connected in either series or parallel;

a switch that is selectable by a user and configured to at least one of independently switch on or off at least one of the first LED circuit or the at least one additional LED circuit, or switch at least one of the first LED circuit or the at least one additional LED circuit to a different level of brightness;

a driver connected to the first operating LED circuit and the at least one LED circuit;

wherein the LED lighting device is configured to connect to an AC mains power source;

wherein the driver has an output voltage lower than the AC mains power source and increases a frequency to be higher than the AC mains power source frequency; and wherein the first operating LED circuit and the at least one additional LED circuit both have a forward voltage of 6V or greater.

2. The LED lighting device of claim 1, wherein the first operating LED circuit and the at least one additional LED circuit are mounted on a reflective substrate.

3. The LED lighting device of claim 1, further comprising:

a light changing or enhancing substance that includes phosphor or nano-crystals, wherein the first LED circuit and the at least one additional LED circuit are integrated with the light changing or enhancing substance in an LED package.

4. The LED lighting device of claim 1, having a standard lamp electrical base.

5. The LED lighting device of claim 1, further comprising a bridge rectifier.

6. A multi-brightness LED lighting device comprising:

a first LED circuit and at least one additional LED circuit, wherein the first LED circuit and the at least one additional LED circuit are connected in parallel;

wherein each of the first LED circuit and the at least one additional LED circuit includes at least two LEDs connected in series;

a switch that is selectable by a user and configured to at least one of independently switch on or off at least one of the first LED circuit or the at least one additional LED circuit;

wherein the LED lighting device is configured to connect to a driver connected to an AC voltage power source;

wherein the driver has an output voltage lower than the AC voltage power source and increases a frequency to be higher than the AC voltage power source frequency;

wherein the first LED circuit and the at least one additional LED circuit both have a forward voltage of 6V or greater; and wherein the first LED circuit and the at least one additional LED circuit are mounted on an insulating substrate.

7. The multi-brightness LED lighting device of claim 6, wherein the insulating substrate comprises sapphire.

8. The multi-brightness LED lighting device of claim 6, further comprising:

a light changing or enhancing substance that includes phosphor or nano-crystals, wherein the first LED circuit and the at least one additional LED circuit are integrated with the light changing or enhancing substance in an LED package.

9. The multi-brightness LED lighting device of claim 6, further comprising the driver.

10. The multi-brightness LED lighting device of claim 9, wherein at least one capacitor is connected to the output of the driver.

11. An LED lighting device comprising:

a first LED circuit and at least one additional LED circuit, each of the first LED circuit and the at least one additional LED circuit including at least two LEDs connected in series or parallel;

a switch, wherein switching of the switch is selectable by a user to independently switch on or off at least one of the first LED circuit or the at least one additional LED circuit;

wherein the LED lighting device is configured to connect to a driver connected to an AC voltage power source;

wherein the driver has an output voltage lower than the AC voltage power source and increases a frequency to be higher than the AC voltage power source frequency;

wherein the first LED circuit and the at least one additional LED circuit both have a forward voltage of 6V or greater; and wherein the first LED circuit, the at least one additional LED circuit, and the switch are integrated within or onto an LED package.

12. The LED lighting device of claim 11, wherein the LED package includes a heat sink and a lens.

13. The LED lighting device of claim 11, wherein said first LED circuit and said at least one additional circuit are mounted on a reflective substrate.

14. The LED lighting device of claim 11, wherein said LED package includes a bridge rectifier and the driver.

15. The LED lighting device of claim 11, wherein the AC voltage power source is a mains power source, and wherein the LED lighting device is configured to be coupled to a dimmer switch, wherein the dimmer switch adjusts a voltage of the mains power source to dim the first LED circuit or the at least one additional LED circuit regardless of a user's selection via the switch.

16. An LED lighting device comprising:

a first operating LED circuit and at least one additional LED circuit, wherein at least one of the first operating LED circuit or the at least one additional LED circuit includes at least two LEDs connected in either series or parallel;

a switch capable of switching the at least one additional LED circuit on or off, wherein switching of the at least one additional LED circuit is selectable by a user switching the switch;

wherein the LED lighting device is configured to connect to a driver connected to an AC mains power source;

wherein the driver has an output voltage lower than the AC mains power source and increases a frequency to be higher than the AC mains power source frequency;

wherein the first operating LED circuit and the at least one additional LED circuit both have a forward voltage of 6V or greater; and wherein the first operating LED circuit and the at least one additional LED circuit are mounted on a substrate including a heat sink.

17. The LED lighting device of claim 16, further comprising:

a light changing or enhancing substance that includes phosphor or nano-crystals.

18. The LED lighting device of claim 16, further comprising the driver with a 12V output.

19. The LED lighting device of claim 16, further comprising:

a dimmer switch configured to adjust a voltage of the AC voltage power source to dim the first operating LED circuit or the at least one additional LED circuit regardless of a user's selection via the switch.

* * * * *